United States Patent [19]

Beimgraben

[11] Patent Number: 4,522,272

[45] Date of Patent: Jun. 11, 1985

[54] APPARATUS FOR DIRECTIONAL DRILLING OF SUBTERRANEAN WELLS

[75] Inventor: Herbert W. Beimgraben, Houston, Tex.

[73] Assignee: Baker Oil Tools, Inc., Orange, Calif.

[21] Appl. No.: 473,185

[22] Filed: Mar. 8, 1983

[51] Int. Cl.[3] ..... E21B 7/08

[52] U.S. Cl. ..... 175/74; 175/61; 175/107

[58] Field of Search ..... 175/74, 256, 45, 61; 285/333, 334, 390, 178, 184; 464/18, 19, 20, 183; 403/160

[56] References Cited

U.S. PATENT DOCUMENTS

| | | | |
|---|---|---|---|
| 3,586,116 | 6/1971 | Tiraspolsky et al. | 175/256 |
| 4,077,657 | 3/1978 | Trzeciak | 175/256 |
| 4,303,135 | 12/1981 | Benoit | 175/256 |
| 4,309,048 | 1/1982 | Ahlf et al. | 285/184 |

*Primary Examiner*—Stephen J. Novosad
*Assistant Examiner*—Michael Goodwin
*Attorney, Agent, or Firm*—Norvell & Associates

[57] ABSTRACT

An apparatus is provided for effecting a change in direction of a rotary drill bit relative to a work string. Two tubular components incorporated into the work string have a rotationally adjustable connection for angularly displacing the drill bit axis relative to the tubing string. One embodiment has the connection between a housing for the shaft of the drill bit and the housing for the motor which drives the shaft. The connection comprises a pair of cylindrically disposed interengagable surfaces formed on the adjacent ends of the motor shaft housing and the drill bit housing, which have axes that are slightly angularly displaced from the housing axes.

3 Claims, 8 Drawing Figures

APPARATUS FOR DIRECTIONAL DRILLING OF SUBTERRANEAN WELLS

BACKGROUND OF THE INVENTION

1. FIELD OF THE INVENTION

This invention relates to an improved apparatus for effecting a change in direction of a rotary drill bit relative to a tubing string to change the direction of the bore of a subterranean well.

2. DESCRIPTION OF THE PRIOR ART

The changing of the direction of drilling of the bore of a subterranean well is an expedient long practiced by well drillers. In many instances, the change in direction is to produce a straightening of the well due to the deflection of the rotary drill from the desired direction by a particular rock strata. In other instances, the change in direction is intentional in order to reach a formation that is laterally displaced from the existing position of the bore hole.

One of the most common expedients for changing the direction of drilling has been the insertion in the tubing, drilling or work string formed by interconnection tubing sections at a point above the fluid motor which drives the rotary drill bit, an apparatus which is called a "conventional bent sub". Such conventional bent subs are rigidly connected at one end to the tubing string and have their other connecting end angularly disposed relative to the axis of the tubing string to which they are connected, so that a fluid motor and supported drill bit are rigidly connected thereto. The axis of the drill bit will be angularly inclined relative to the axis of the well bore existing prior to insertion of the conventional bent sub.

Because the change in angle has heretofore been accomplished at a substantial distance above the rotary drill bit, a large degree of interference is created between the conventional bent sub, the rotary drill bit and the well bore wall as the tubing string is lowered into the hole to where drilling will begin. To effect a desired change in angle, which generally is on the order of a fraction of a degree, it was necessary to remove the motor and drill bit from the end of the work string and insert a particular conventional bent sub which had the desired angular deviation incorporated therein. This method requires the maintenance of an inventory of conventional bent subs having different deviation angles at the drilling site.

There is, therefore, a recognized need in the well drilling industry for an apparatus which will permit a selected, change in well bore drilling direction to be effected without the large degree of interference between the tubing string, drill bit and bore wall and also to avoid maintenance of a large inventory of conventional bent subs.

SUMMARY OF THE INVENTION

This invention provides an improved apparatus for changing the drilling direction of a drilling bit by a predetermined selected minute amount, measurable in minutes of a single degree, by incorporating a special coupling apparatus in the tubing string. These coupling apparatus can comprise two matable tubular members or subs which can be incorporated between standard tubing sections forming the rotary drill bit tubing string. In another embodiment the coupling is between the housing that mounts the drive shaft for the rotary drill bit and the cooperating housing which mounts the output shaft of a fluid motor which is connected to the drill bit drive shaft by a universal joint.

Apparatus embodying this invention includes cylindrically disposed interengagable surfaces such as threads, splines or flanges formed on the lower end and the upper end of coupling members. In one embodiment these coupling members are the motor shaft housing and the drill bit housing, and the cylindrically disposed surfaces have a common axis that is slightly angularly displaced from the axes of the housings. For example, an angular deviation on the order of one degree between the common axis and the axis of the motor and drill bit shaft housings will provide a total effective angular deviation of up to two degrees merely by rotating one housing relative to the other by an angular amount sufficient to produce the desired displacement of the axis of the rotary drill bit. The angularly adjusted housings can then be secured in their selected angular position.

The cylindrically disposed interengagable surfaces on the tubular coupling apparatus or members can be concentric male and female threads, cylindrical surfaces, cylindrically disposed axially extending splines or flanges on the separate members. Each interconnection can be rotationally adjusted and then secured at the selected angular displacement.

By permitting the selection of the angular position of the axis of the rotary drill bit relative to the motor to be effected merely by changing the angular relationship of the two housings, it is readily apparent that this operation can be quickly and accurately performed by the drill crew on the floor of the drilling rig. Moreover, a visual indication of the selected directional change is provided by indicia scribed on or otherwise suitably mounted on the adjacent surfaces of the two housings, so that no measurements are required on the part of the drilling operator.

DESCRIPTION OF THE PREFERRED EMBODIMENTS

The coupling apparatus for use in effecting directional drilling can be used in a rotary drill bit tubing string in many embodiments which will be deemed substantially interchangable by those skilled in the art. The coupling can comprise two tubular members, such as coupling subs, inserted into the tubing string between standard tubing sections forming the string. The coupling apparatus can also comprise the housings for the motor output shaft and the rotary drill bit drive shaft.

Figure 1:
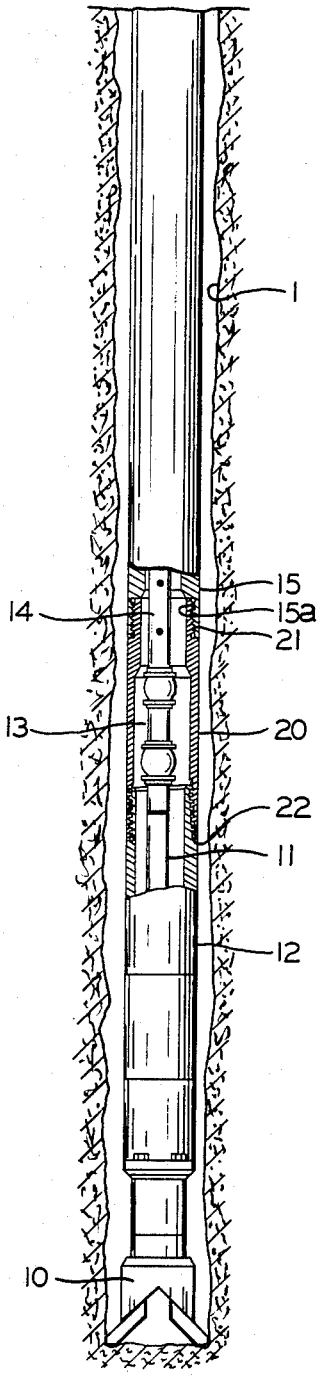
FIG. 1 is an elevational view, partly in section of an adjustable direction well drilling apparatus embodying this invention, shown within a well bore with the axis of the rotary drill bit aligned with the tubing string.

Referring to FIG. 1, there is schematically illustrated the major components of a rotary drilling apparatus employed in drilling a well bore 1. Such apparatus includes a rotary drill bit 10 which is driven by a shaft 11 which is suitably journalled in a bearing housing 12. Shaft 11 is connected to the lower end of a universal joint 13, which in turn is connected to the bottom end of an output shaft 14 of a motor contained within a housing 15. Conventional motors, such as hydraulically or electrically driven motors, can be employed. Upper tubular housing 15 has threads 15*a* at its lower end which are engaged with cooperating threads 21 of a lower connecting tubular housing 20 which surrounds the universal joint assemblage 13. Connection housing 20 thus constitutes an extension of motor housing 15, and each housing forms a coupling apparatus incorporated into the tubing string.

The lower end of connecting housing 20 is secured to the upper end of the shaft housing 12 by a special joint constructed in accordance with this invention which permits adjustment of the angular position of the axis 12*b* (FIG. 4) of the housing 12, hence drive shaft 11, relative to the axis 15*b* of the motor housing 15. The joint in one preferred embodiment is provided by the interengagement of concentric male and female surfaces which may be formed on the lower end of the connecting housing 20 and the upper end of the shaft housing 12. Such surfaces have a common axis that is indicated at 32 (FIG. 3) that is slightly angularly displaced from the normal vertical and aligned axes 12*b* and 15*b* of the shaft housing 12 and the motor housing 15, respectively.

Figure 4:
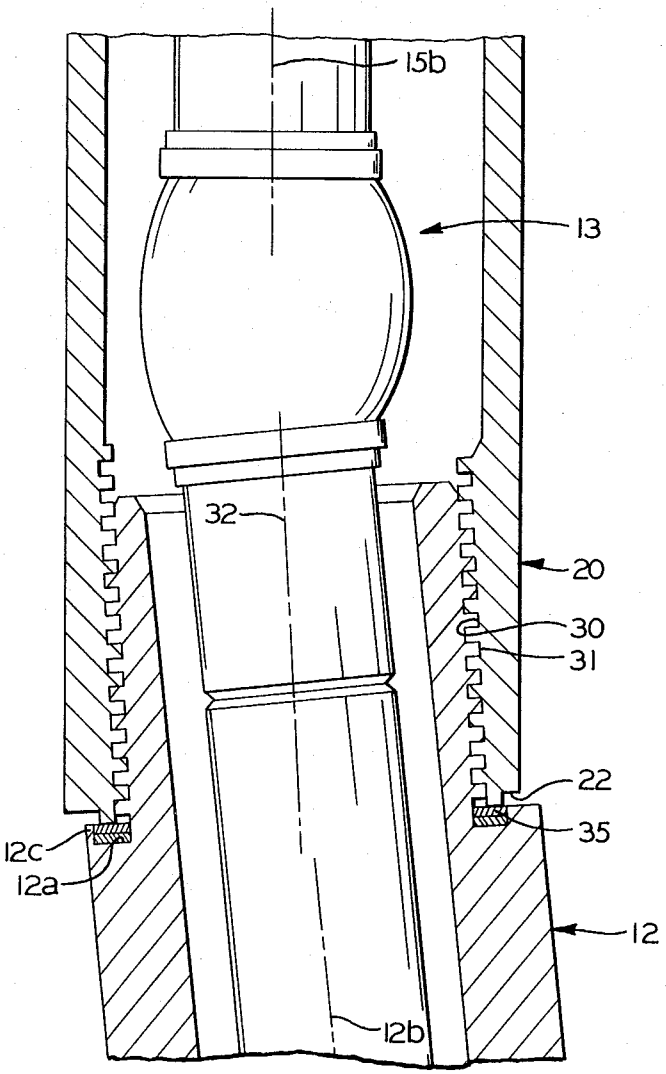
FIG. 4 is an enlarged scale, vertical sectional view of the adjustment components in the position of FIG. 2.
Figure 3:
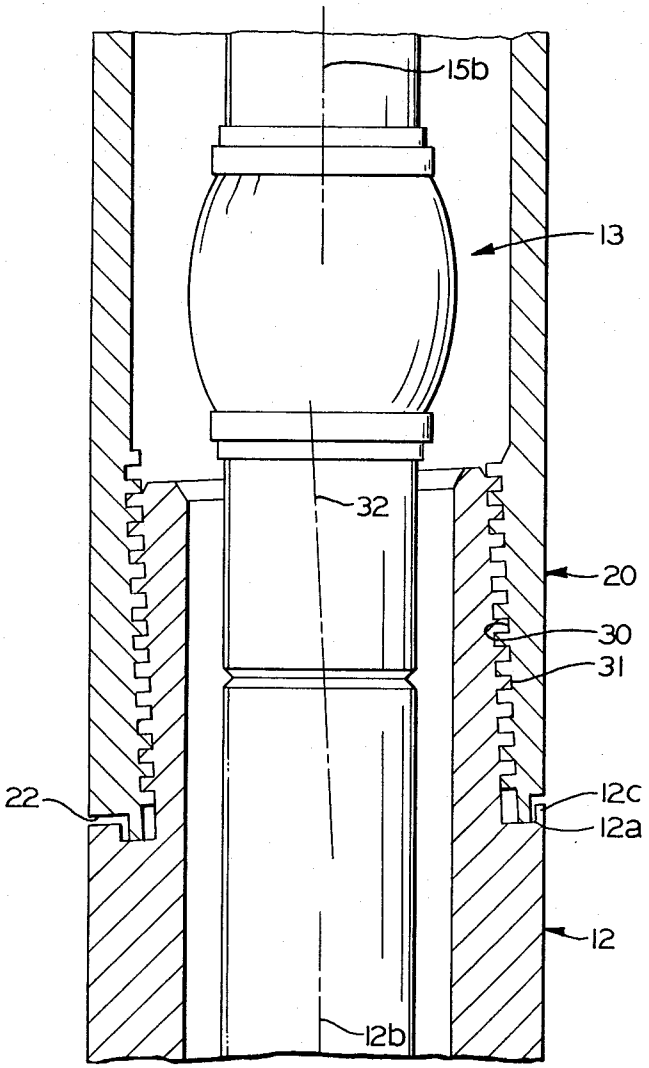
FIG. 3 is an enlarged scale, vertical sectional view of the adjustment components in the position of FIG. 1.

Referring now to the enlarged scale view of FIG. 3, such concentric cylindrically disposed interengaging surfaces may comprise a female square thread 30 formed on the lower end of connecting housing 20 and a cooperating male thread 31 formed on the upper end of shaft housing 12. Obviously, the female thread could be provided on the shaft housing 12 and the male thread on the connecting housing 20. Thus, as the shaft housing 12 is angularly adjusted relative to connecting housing 20 on the cooperating threads 30 and 31, a deviation in the angle of the axis 12*b* of motor shaft housing 12 relative to the axis 15*b* of connecting housing 20 and motor housing 15 will result, as indicated in FIG. 4.

In the arrangement of the components shown in FIG. 3, the angular relationship of the two housings on their cooperating threads is such that the angular deviation of each thread axis relative to the axis of its respective housing is equal and opposite, the two housings end up being disposed in an aligned position with the axis 15*b* of the motor housing 15, which is shown as vertical in FIG. 3. The axis of the tubing string (not shown), from which the motor housing 15 is conventionally suspended, is also aligned with the housing axes in FIG. 3.

Figure 2:
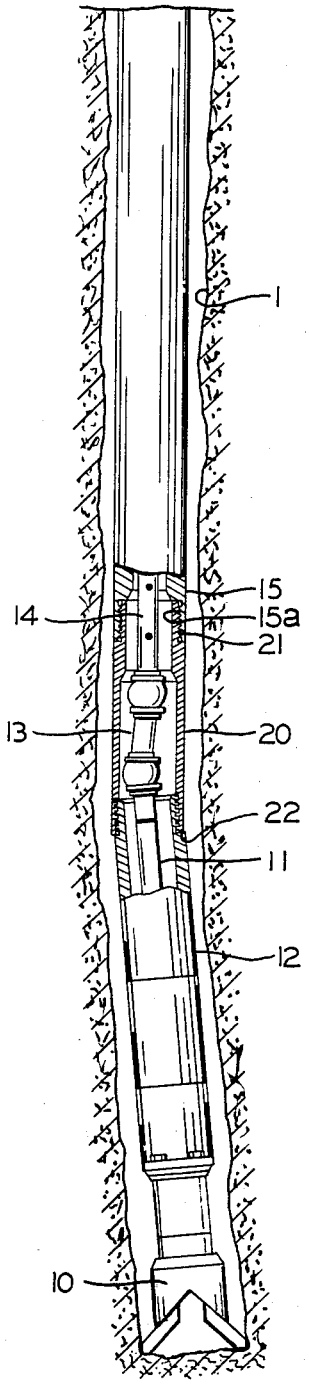
FIG. 2 is a view similar to FIG. 1 but with the apparatus adjusted to dispose the drill bit at a selected angle relative to the tubing string.

As the drill shaft housing 12 is rotated in either direction relative to connecting housing 20 on threads 30 and 31, an increasing angular deviation of the axis 12*b* of the drill shaft housing 12 relative to the axis 15*b* of the motor housing 15 will result, hence there is a change in direction of the rotary drill bit 10 as illustrated in an exaggerated degree in FIG. 2. Normally, the angular deviation of the common axis 32 of the cooperating threads 30 and 31 from the axes of their respective housings is on the order of one degree, so that the maximum angular directional deviation of the axis of the rotary drill bit 10 relative to the motor housing 15. and hence the tubing string, is on the order of two degrees.

Referring again to FIGS. 3 and 4, it will be apparent that some means for securing the cooperating threads 30 and 31 in any selected angular adjustment position must be provided. To effect such securement, the outboard end of connecting housing 20 is provided with a generally radial end face 22 which is perpendicular to the axis 32 of the threads 30 provided on the lower end of the connecting housing 20. Similarly, a radial shoulder 12*a* is provided on the inboard end of the threads 31 provided on the top end of the drill shaft housing 12 which is perpendicularly disposed relative to the axis 32 of the threads 31. Such threads may be machined so that the end surface 22 of connecting housing 20 is in approximate abutment with the shoulder 12*a* as shown in FIG. 3.

As the threads 30 and 31 are angularly turned relative to each other from the FIG. 3 position, a separation will be produced between the previously abutting surfaces 22 and 12*a* as illustrated in FIG. 4. To affect the locking of the screw threads 30 and 31 in any such adjusted position, a plurality of C-shaped shims 35 are provided which are inserted into the space between the surfaces 22 and 12*a*. Such shims are quite thin in order to provide the desired degree of flexibility to permit them to be assembled between the shoulders 22 and 12*a* and also to permit minute adjustments in the angular position of the cooperating threads 30 and 31. Shims 35 are preferably constructed from a material that has at least the same resistance to compression as the materials from which the housings 12 and 20 are formed so that the compressive loads normally encountered in the connection between the housing 20 and the drill shaft housing 12 will not result in any significant compressive deformation of such shims which would permit the loosening of the threads 30 and 31 and hence result in an undesired angular deviation of the axis of the drill bit 10.

If desired, an upstanding annular flange 12*c* may be provided on the periphery of the surface 12*a* to retain the shims 35 in their desired position.

From the description thus far, it will be appreciated that the cooperating concentric threads 30 and 31 could be replaced by two concentric cylindrical surfaces and the same type of angular adjustment of the shaft housing 12 relative to the connecting housing 20 would be achieved. There is, however, the problem of transmitting torque through such a joint if cylindrical surfaces were substituted for the threads 30 and 31.

Figure 6:
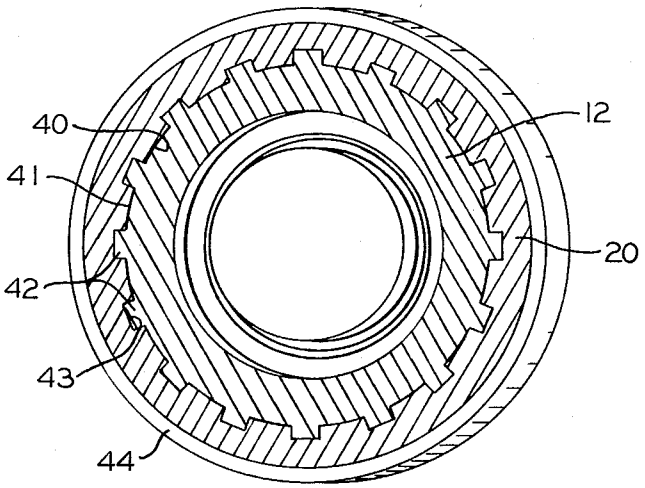
FIG. 6 is a sectional view taken on the plane 6—6 of FIG. 5.
Figure 5:
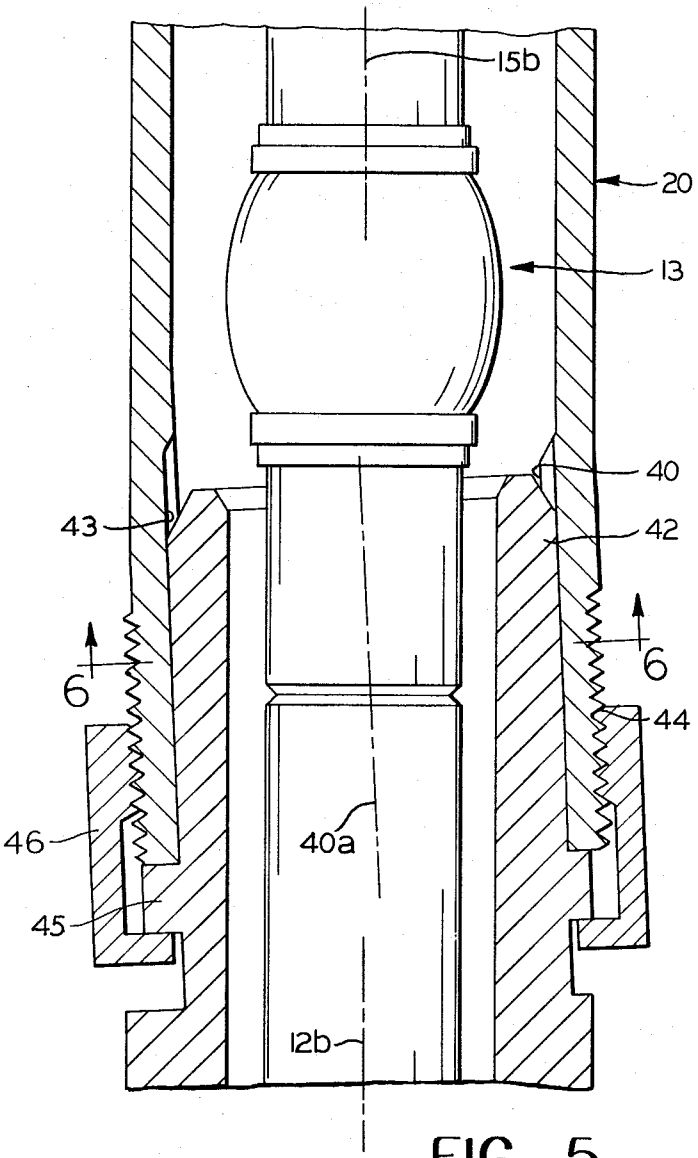
FIG. 5 is a view similar to FIG. 3 of a modification of this invention.

Referring now to FIGS. 5 and 6, there is shown a modification of this invention wherein the cooperating surfaces 40 and 41 corresponding to the threads 30 and 31 comprise cylindrical surfaces respectively provided with cylindrically disposed, peripherally spaced, axially extending splines 42 and cooperating axial grooves 43. Again, it is immaterial as to whether the splines are provided on the upper end of the shaft housing 12 or on the lower end of the connecting housing 20.

To effect the locking of the cooperating concentric surfaces 40 and 41 in any selected angular position, the connecting housing 20 is provided with the external threads 44 which are concentric about the common axis 40*a* of the cooperating splined concentric surfaces 40 and 41. The drive shaft housing 12 is provided at its upper end with shoulder 45 which is likewise concentric with respect to the common axis 40*a*. A jam nut 46 may then be provided which concurrently engages the thread 44 and shoulder 45 affects the securement of the two housings 20 and 12 in any selected relative angular position.

When nut 46 is backed off threads 45, angular adjustment may be accomplished by axially separating shaft housing 12 from connecting housing 20, thus disengaging splines 42 from slots 43, relatively rotating the two housings the desired amount, and then axially reinserting splines 42 in slots 43.

Figure 8:
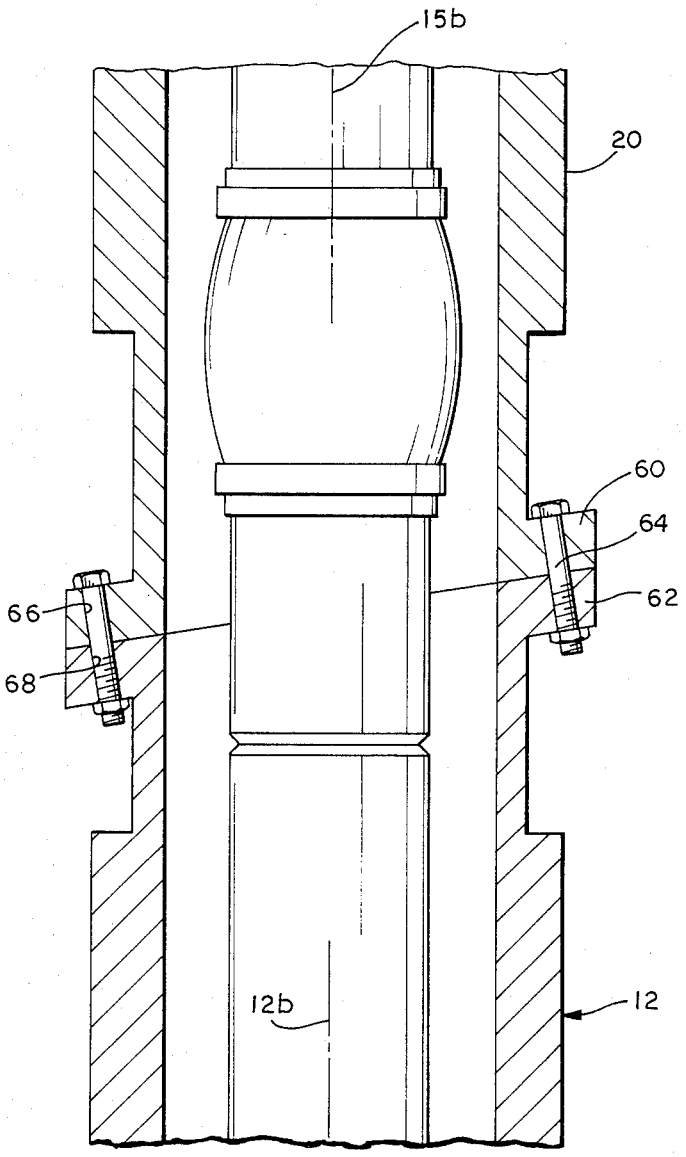
FIG. 8 is a view of a flanged interconnection.

FIG. 8 illustrates another embodiment of the cylindrically disposed interengaging surfaces which can be provided on housings 12 and 20. Peripherally extending flanges 60 and 62 are shown in mating abutting relationship in a configuration analagous to FIG. 3. The free ends of flanges 60 and 62 are inclined relative to the housing axis and contact on a common inclined plane upon assembly. In FIG. 3, this housing free ends are oriented relative to this common plane so that the housing axes 15*b* and 12*b* are in alignment. Mutual relative rotation of the housings will change the orientation of the free end of at least one housing relative to the common plane resulting in an angular housing displacement of one housing axis relative to the other when the housings are assembled.

The flanged connections of flanges 60 and 62 can be assembled and dissembled by using conventional threaded pin fasteners 64 to secure the housings. A plurality of holes 66 and 68, located around the flanges, and one or more holes receive a pin fastener when mutually aligned.

Figure 7:
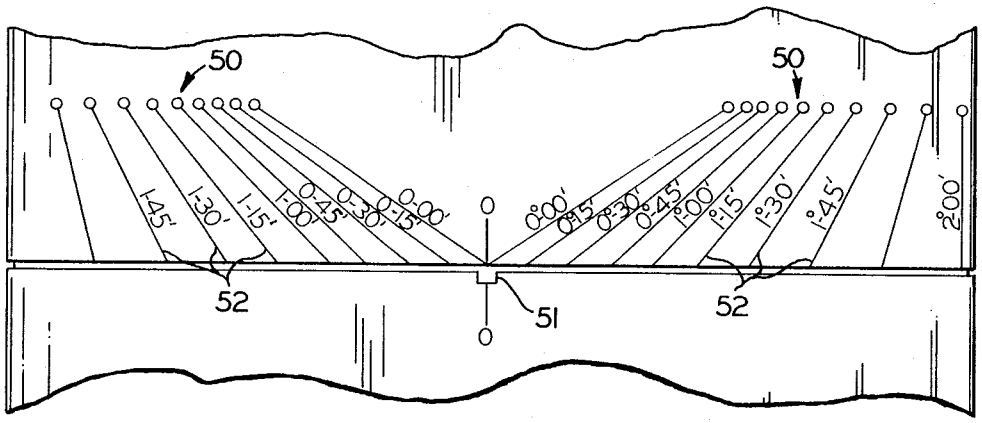
FIG. 7 is a developed view of one form of angular deviation indicia which may be employed in the modification of FIGS. 3 and 4.

To conveniently indicate to the drill crew the relative angular deviation of the rotary drill bit 10 with respect to the axis of the motor housing 15, indicia 50 (FIG. 7) may be provided around the periphery of the abutting ends of the drill shaft housing 12 and the connecting housing 20. Such indicia are shown in developed relationship in FIG. 7 and may comprise a notch 51 formed in the edge of one of the housings and a plurality of angularly extending lines scribed onto, or adhesively secured to the other housing. As the housings 12 and 20 are angularly adjusted, the indicia lines 52 will be successively moved into alignment with the notch 51. The 'zero' position corresponds to FIG. 1.

The aforedescribed apparatus provides a convenient arrangement for securing change in direction of the rotary drill bit 10 with respect to the motor housing and the supporting tubing string. It is no longer necessary to separate the motor housing from the tubing string, as has been the practice when employing bent subs to achieve directional drilling. More importantly, a large number of angular adjustments may be made in very minute steps with the aforedescribed apparatus and can be accomplished by the drilling crew on the floor of the drilling rig. For one embodiment, the only inventory of parts required is a supply of shims in the case of the modification of FIGS. 3 and 4. No additional parts are required in the modification of FIGS. 5 and 6 or FIG. 8. Most importantly, the change in angle of the rotary drill bit occurs at a location much closer to the rotary drill than is possible when employing bent subs. This minimizes interference of the directionally changed apparatus with the well bore 1 when the work string and drill bit 10 are again inserted in the well to continue the drilling in a different direction.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An apparatus for effecting directional drilling of a well bore with use of a rotary drill bit, comprising: a drive shaft extending to said rotary drill bit; a first sleeve like housing surrounding and supporting said drive shaft; a motor having an output shaft; a second sleeve like housing enclosing and supporting said motor output shaft; a universal joint connection between said motor output shaft and said drive shaft; concentric male and female threads interconnecting the upper end of first housing and the lower end of said second housing in the axial vicinity of said universal joint connection; said concentric male and female threads having common axes angularly displaced from the housing axes, whereby rotational displacement of one housing relative to the other will angularly displace the axis of the rotary drill bit to change the well bore direction; a radial shoulder formed on each of said housings at the inboard end of said male thread and on the outboard end of said female thread, a selected number of annular shims being insertable between said shoulders to determine the angular displacement of said housing upon tightening of said threads to compress said shims between said radial shoulders, the planes of said radial shoulders being respectively perpendicular to said common axes of said male and female threads.

2. The apparatus of claim 1 wherein one of said radial shoulders has an axially extending peripheral flange formed thereon to retain said shims in position.

3. The apparatus of claim 1 or 2 wherein said shims are formed of a material having resistance to compressibility at least equal to that of said housings.

* * * * *